US007448922B1

(12) United States Patent
Chan

(10) Patent No.: US 7,448,922 B1
(45) Date of Patent: Nov. 11, 2008

(54) WIRE CONNECTOR WITH EASY ENTRY AND MANUFACTURING METHOD THEREOF

(75) Inventor: Chin Jung Chan, Chang Hwa Hsien (TW)

(73) Assignee: K.S. Terminals, Inc., Chang Hwa Hsien (TW)

( * ) Notice: Subject to any disclaimer, the term of this patent is extended or adjusted under 35 U.S.C. 154(b) by 0 days.

(21) Appl. No.: 12/013,807

(22) Filed: Jan. 14, 2008

(30) Foreign Application Priority Data

Oct. 31, 2007 (CN) ..... 96 1 41087

(51) Int. Cl.
*H01R 4/02* (2006.01)

(52) U.S. Cl. ..... 439/874; 439/886

(58) Field of Classification Search ..... 439/874, 439/875, 883, 884, 886
See application file for complete search history.

(56) References Cited

U.S. PATENT DOCUMENTS

| | | | |
|---|---|---|---|
| 4,586,971 | A | 5/1986 | Wallace |
| 4,595,724 | A | 6/1986 | Koblitz |
| 4,696,841 | A | 9/1987 | Vidakovits |
| 4,883,925 | A | 11/1989 | Graf |
| 5,137,478 | A | 8/1992 | Graf |
| 5,150,931 | A | 9/1992 | Hagio et al. |
| 5,174,616 | A | 12/1992 | Hagio |
| 5,278,354 | A | 1/1994 | Lhomme |
| 5,369,225 | A | 11/1994 | Natwig |
| 5,371,322 | A | 12/1994 | Selmeski |
| 5,393,932 | A | 2/1995 | Young |
| 5,406,031 | A | 4/1995 | Mathieu |
| 5,509,202 | A | 4/1996 | Abdow |
| 5,551,138 | A | 9/1996 | Grajewski |
| 5,574,258 | A | 11/1996 | Blonder |
| 6,315,527 | B1 | 11/2001 | Makino |
| 6,666,732 | B1 | 12/2003 | Endacott |
| 6,677,529 | B1 | 1/2004 | Endacott |
| 6,838,621 | B2 | 1/2005 | Endacott |

*Primary Examiner*—Khiem Nguyen
(74) *Attorney, Agent, or Firm*—Ming Chow; Sinorica, LLC

(57) ABSTRACT

The invention provides a wire connector with easy entry and a manufacturing method thereof. The wire connector with easy entry includes an insulating tube with an outer corrugated surface and a soldering sleeve disposed in the insulating tube. The soldering sleeve includes a pair of smoothly radially expanded portions at two ends. When a heat source properly applied to an outer periphery of the insulating tube that corresponds to the soldering sleeve, it causes the heated insulating tube to shrink to lodge into corrugation of the outer surface and affix to end surfaces outside end points of the radially expanded portions, an inner periphery of the insulating tube forms a smoothly converging configuration oriented toward each end point of the radially expanded portion, thereby the conducting core is allowed to be readily inserted.

8 Claims, 3 Drawing Sheets

WIRE CONNECTOR WITH EASY ENTRY AND MANUFACTURING METHOD THEREOF

BACKGROUND OF THE INVENTION

1. Field of the Invention

The present invention relates to a wire connector with easy entry and a manufacturing method thereof, and more particularly, to a wire connector with easy entry that employs an insulating tube and a soldering sleeve as a joining device for joining a plurality of wires.

2. Description of Related Art

In a conventional method of joining conducting wires, an insulating adhesive tape is used to wind around conducting cores of the conducting wires that are exposed to an outside of insulating claddings of the conducting wires, such that the conducting cores are connected with each other to achieve electrical conduction therebetween. However, due to the use of the adhesive tape, the conducting wires may be easily affected by the environment to cause problems such as an electric leakage or being affected with damp. In attempts to address these problems, U.S. Pat. No. 4,883,925 proposed a wire connecting device 1, as shown in FIG. 1. The wire connecting device 1 includes an insulating tube 11 with an adhesive coating 111 on an inner surface of the insulating tube 11. A solder sleeve 112 with smooth outer and inner surfaces is disposed in the insulating tube 11. The outer surface of the solder sleeve 112 is fixed with the inner surface of the insulating tube 11 by the adhesive coating 111. An external heat source is then used to melt the solder sleeve 112 to thereby join the conducting cores of the two conducting wires. The insulating tube 11 is then heated to shrink to position the conducting wires, thereby achieving the conducting wire connection and electrical conduction. However, forming the adhesive coating 111 on the inner surface of the insulating tube of the connecting device 1 leads to a high cost. In addition, it can be difficult to dispose the solder sleeve 112 into the insulating tube 11 after the formation of the adhesive coating 111. Therefore, there is still room to improve the conventional construction described above.

SUMMARY OF THE INVENTION

In attempt to solve one or more problems described above, the present invention provides a wire connector with easy entry and a manufacturing method thereof. The wire connector with easy entry includes an insulating tube and a soldering sleeve, and is suitable for interconnecting multiple wires that each includes a conducting core and an insulating cladding enclosing the conducting core. The insulating tube has a characteristic of shrinking when being heated to a temperature higher than a first temperature and has a melting point at a second temperature. The soldering sleeve is disposed in the insulating tube and has a melting point at a third temperature that is between the first temperature and the second temperature. The soldering sleeve has an outer surface that is corrugated, and comprises a pair of smoothly radially expanded portions at two ends of the soldering sleeve. When a heat source is properly applied to an outer periphery of the insulating tube that corresponds to the soldering sleeve to heat the insulating tube to a temperature above the first temperature but below the third temperature, causing the heated insulating tube to shrink to lodge into corrugation gaps of the outer surface and affix to end surfaces outside end points of the radially expanded portions, an inner periphery of the insulating tube forms a smoothly converging configuration oriented toward each end point of the radially expanded portion, thereby achieving the wire connector with easy entry such that the insulating tube and the soldering sleeve are tightly connected and the conducting core is allowed to be readily inserted from the two ends of the soldering sleeve.

Accordingly, in one aspect, the present invention provides a wire connector with easy entry which can be manufactured with a simplified method and in which the insulating tube and the soldering sleeve can be tightly connected and the conducting core can be readily inserted by forming a pair of smoothly radially expanded portions at two ends of the soldering sleeve.

In another aspect, the present invention provides a simplified method for manufacturing a wire connector with easy entry. In the wire connector with easy entry so manufactured, the insulating tube and the soldering sleeve can be tightly connected and the conducting core can be readily inserted.

In still another aspect, the present invention provides a soldering sleeve of a wire connector with easy entry that allows the conducting core to be readily inserted into the soldering sleeve by including a pair of smoothly radially expanded portions at two ends of the soldering sleeve.

DETAILED DESCRIPTION OF THE PREFERRED EMBODIMENTS

The present invention discloses a wire connector with easy entry and a manufacturing method of the wire connector. The method of manufacturing the wire connector has been known to those of ordinary skill in the art and is therefore not described in detail in the following description. Also, it is to be understood that the drawings referred to in the following description are merely schematic views showing features of the present invention and are not made, also unnecessary to be made, according to practical dimensions.

Figure 1:
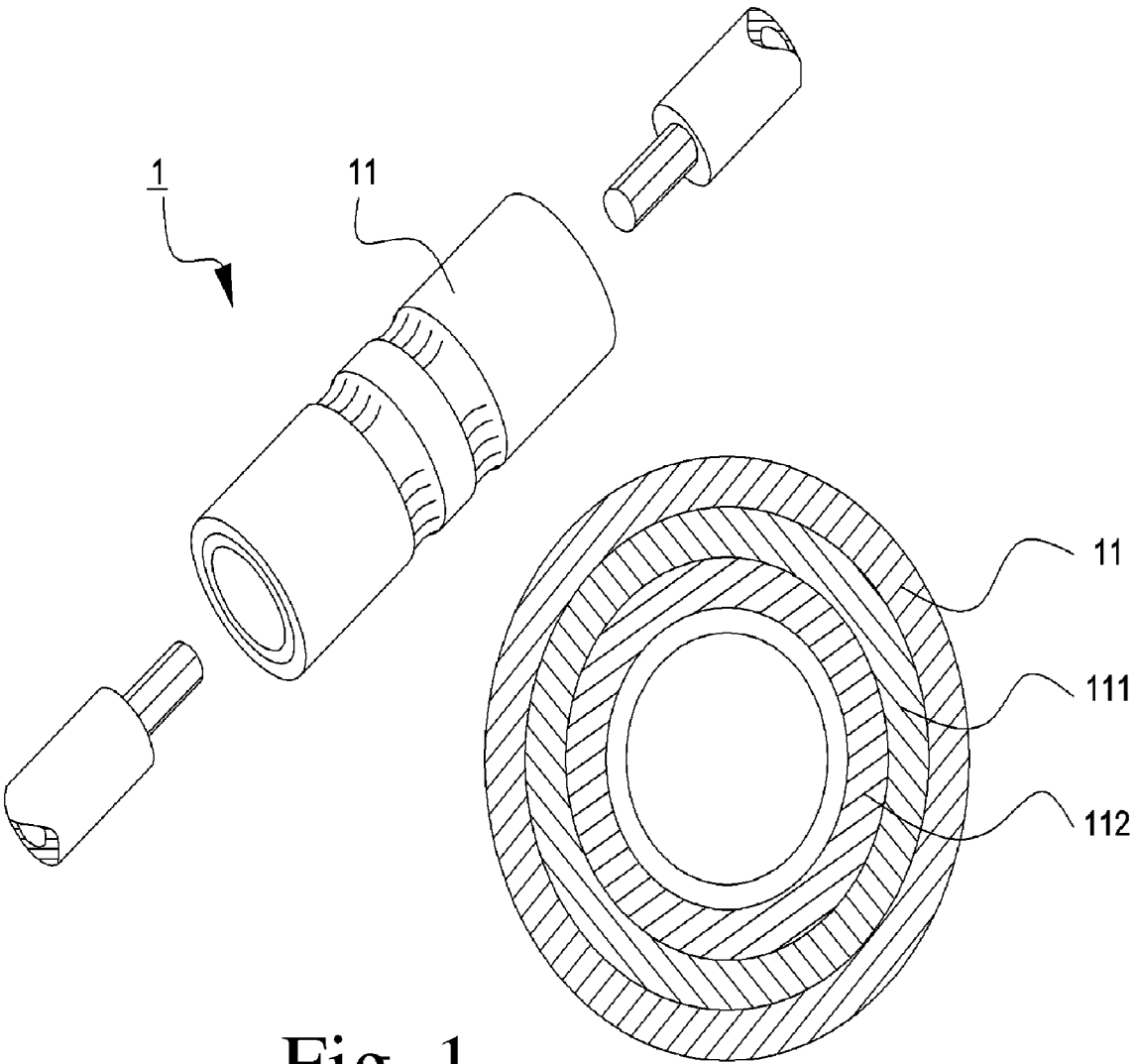
FIG. 1 illustrates a conventional wire connector with easy entry.
Figure 2:
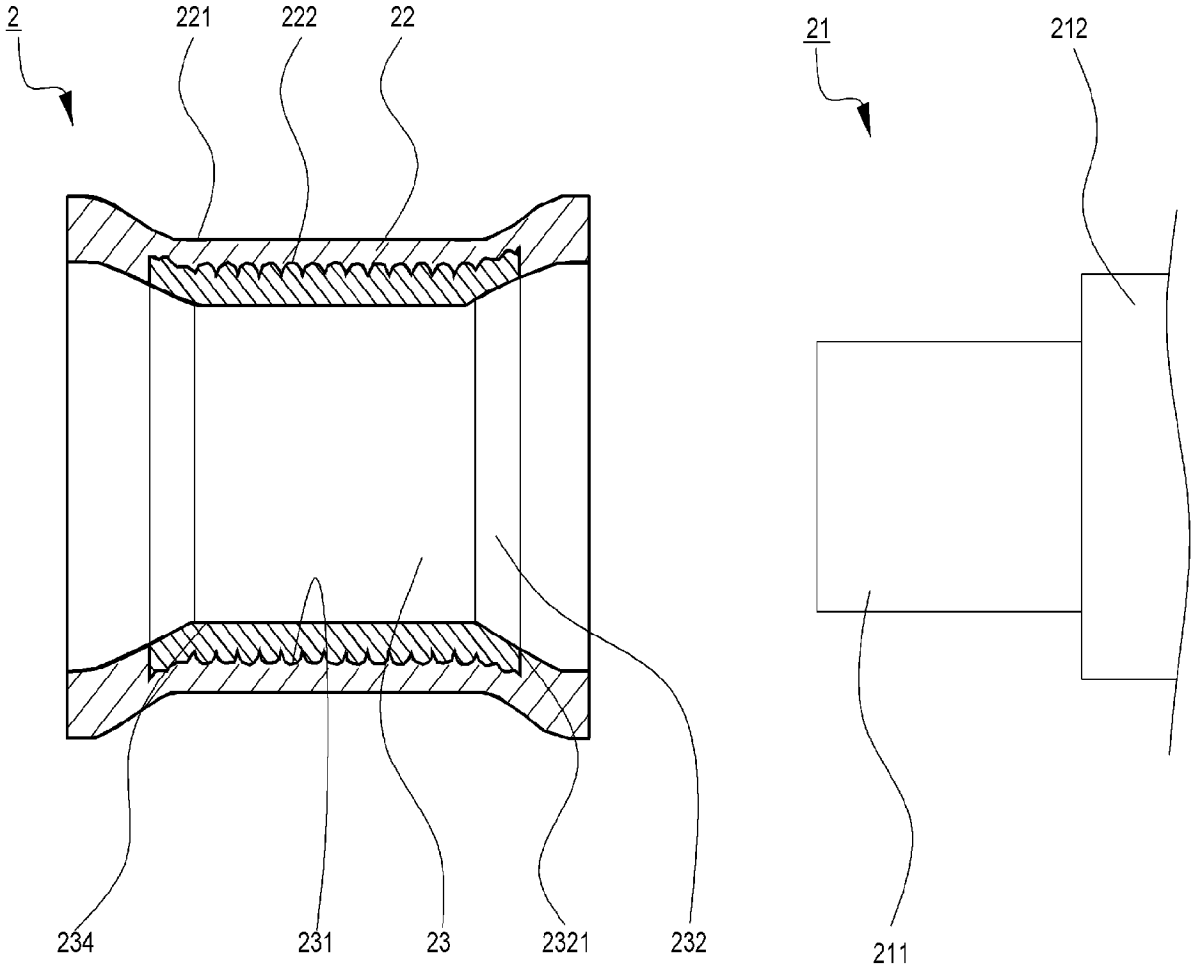
FIG. 2 illustrates a wire connector with easy entry in accordance with a first preferred embodiment of the present invention.

FIG. 2 illustrates a wire connector with easy entry in accordance with a first preferred embodiment of the present invention. The wire connector with easy entry 2, which is suitable for interconnecting multiple wires 21 that each includes a conducting core 211 and an insulating cladding 212 enclosing the conducting core 211, includes an insulating tube 22 and a soldering sleeve 23. The insulating tube 22, when being heated to a temperature higher than a first temperature, shrinks due to its own material characteristic and has a melting point at a second temperature.

The soldering sleeve 23 is received in the insulating tube 22. The material of the soldering sleeve 23 may be made of tin, lead, nickel, gold, silver, bismuth or alloy of these metals. The soldering sleeve 23 has an outer surface 231 that is corrugated, and an inner surface 234 that may also be corrugated. The soldering sleeve 23 includes a pair of smoothly radially expanded portions 232 formed at two ends of the soldering sleeve 23 for guiding the conducting core 211 to insert into the soldering sleeve 23, thereby facilitating the insertion of the conducting core 211. The soldering sleeve 23 has a melting point at a third temperature that is between the first temperature and the second temperature. When a heat source is properly applied to an outer periphery 221 of the insulating tube 22 that corresponds to the soldering sleeve 23, the heated insulating tube 22 shrinks, due to its own material characteristic, to lodge into corrugation gaps of the outer surface 231 of the soldering sleeve 23 and affix to end surfaces outside end points 2321 of the radially expanded portions 232, such that an inner periphery 222 of the insulating tube 22 forms a smoothly converging configuration oriented toward each end point 2321 of the radially expanded portion 232. With this smoothly converging configuration, the wire connector with easy entry 2 is achieved such that the insulating tube 22 and the soldering sleeve 23 are tightly connected and the conducting core 211 is allowed to be readily inserted from the two ends of the soldering sleeve 23.

In the above-described embodiment, the corrugated surface of the soldering sleeve 23 may be either a wavy surface or a serrated surface. The waves of the wavy surface may have a same or different height. The gaps between the waves may have a same or different width. Preferably, the waves of the wavy surface have a same height and the gaps between the waves have a same width. The serrations of the serrated surface may have a same or different height. The gaps between the serrations may have a same or different width. Preferably, the serrations of the serrated surface have a same height and the gaps between the serrations have a same width.

As shown in FIG. 2, the present invention further provides a method for manufacturing a wire connector with easy entry 2 in accordance with a second preferred embodiment. The wire connector with easy entry 2 is suitable for interconnecting multiple wires 21 that each includes a conducting core 211 and an insulating cladding 212 enclosing the conducting core 211. The manufacturing method includes:

(1) providing an insulating tube 22 having a characteristic of shrinking when being heated to a temperature higher than a first temperature and having a melting point at a second temperature;

(2) providing a soldering sleeve 23 having a melting point at a third temperature that is between the first temperature and the second temperature, the soldering sleeve 23 having a corrugated outer surface 231 and including a pair of smoothly radially expanded portions 232 at two ends of the soldering sleeve 23;

(3) disposing the soldering sleeve 23 in the insulating tube 22; and (4) properly applying a heat source to an outer periphery 221 of the insulating tube 22 that corresponds to the soldering sleeve 23 to heat the insulating tube 22 to a temperature above the first temperature but below the third temperature, causing the heated insulating tube 22 to shrink to lodge into corrugation gaps in the outer surface 231 and affix to end surfaces outside end points 2321 of the radially expanded portions 232, such that an inner periphery 222 of the insulating tube 22 forms a smoothly converging configuration oriented toward each end point 2321 of the radially expanded portion 232, thereby achieving the wire connector with easy entry 2 such that the insulating tube 22 and the soldering sleeve 23 are tightly connected and the conducting core 211 is allowed to be readily inserted from the two ends of the soldering sleeve 23.

In the embodiment described above, the insulating tube 22 and the soldering sleeve 23 have the same characteristics as those described in the first preferred embodiment.

As shown in FIG. 2, the present invention further provides a soldering sleeve 23 of the wire connector with easy entry in accordance with a third preferred embodiment. The wire connector with easy entry 2 is suitable for interconnecting multiple wires 21 that each includes a conducting core 211 and an insulating cladding 212 enclosing the conducting core 211. The soldering sleeve 23 has the same characteristics as those described in the first embodiment.

Figure 3:
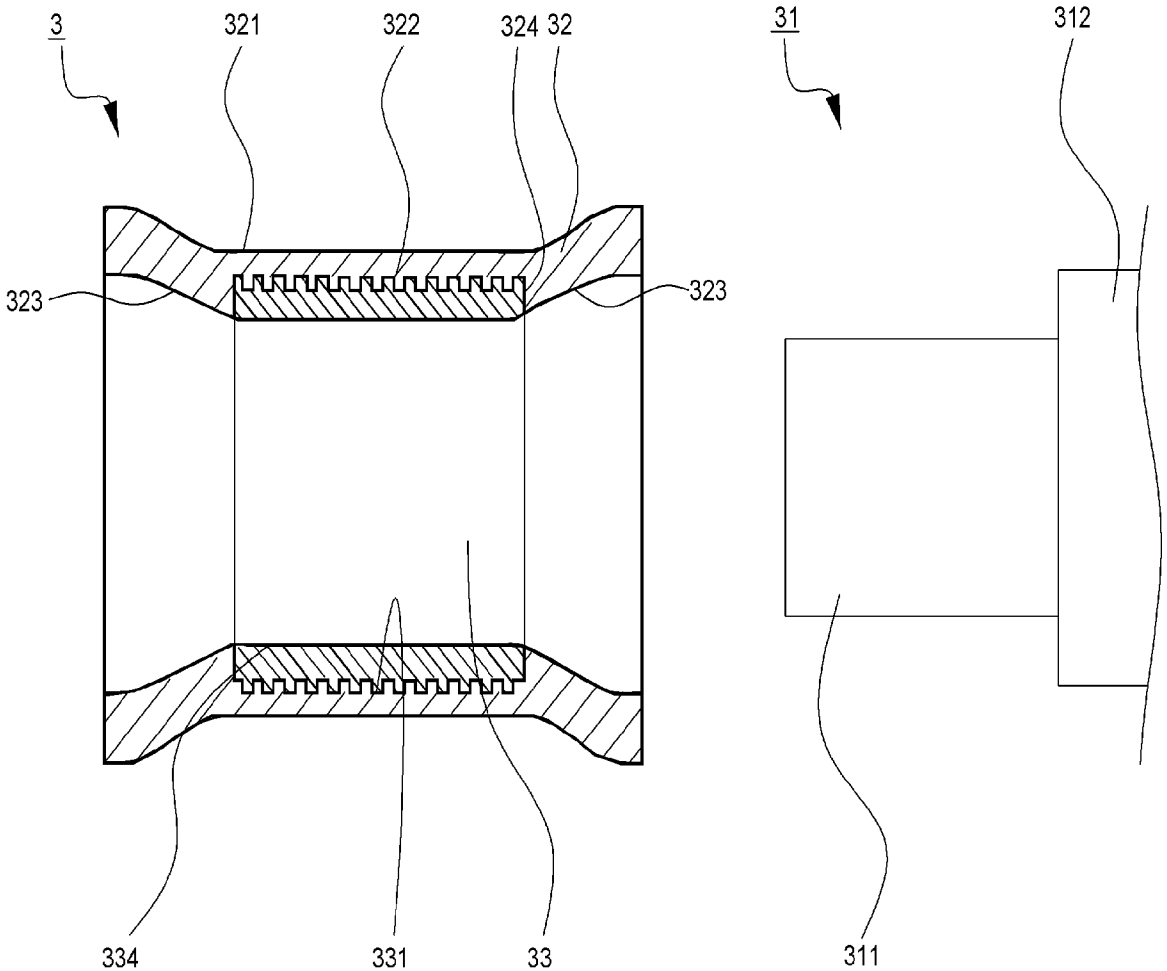
FIG. 3 illustrates a wire connector with easy entry in accordance with a second preferred embodiment of the present invention.

As shown in FIG. 3, the present invention further provides a wire connector with easy entry 3 in accordance with a second preferred embodiment. The wire connector with easy entry 3 is suitable for interconnecting multiple wires 31 that each includes a conducting core 311 and an insulating cladding 312 enclosing the conducting core 311, and includes an insulating tube 32 and a soldering sleeve 33. The soldering sleeve 33 may be constructed in the same way as described in the first embodiment. The insulating tube 32, when being heated to a temperature higher than a first temperature, shrinks due to its own material characteristic and has a melting point at a second temperature.

The soldering sleeve 33 is received in the insulating tube 32. The material of the soldering sleeve 33 may be made of tin, lead, nickel, gold, silver, bismuth or alloy of these metals. The soldering sleeve 33 has an outer surface 331 that is corrugated, and an inner surface 334 that may also be corrugated. In this embodiment, the soldering sleeve 33 has a melting point at a third temperature that is between the first temperature and the second temperature. When a heat source is properly applied to an outer periphery 321 of the insulating tube 32 that corresponds to the soldering sleeve 33, causing the heated insulating tube 32 to shrink, due to its own material characteristic, to lodge into corrugation gaps of the outer surface 331 of the soldering sleeve 33 and affix to end surfaces outside a pair of end points 324 of the soldering sleeve 33, an inner periphery 322 of the insulating tube 32 forms a smoothly converging configuration 323 oriented toward each end point 324. With this smoothly converging configuration, the wire connector with easy entry 3 is achieved such that the insulating tube 32 and the soldering sleeve 33 are tightly connected, and the conducting core 311 is allowed to be readily inserted from two ends of the soldering sleeve 33 so as to prevent the conducting core 311 from being accidentally blocked by the end points 324 of the soldering sleeve 33 when the conducting core 311 is inserted into the soldering sleeve 33.

In the above-described embodiment, the corrugated surface of the soldering sleeve 33 may be either a wavy surface or a serrated surface. The waves of the wavy surface may have a same or different height. The gaps between the waves may have a same or different width. Preferably, the waves of the wavy surface have a same height and the gaps between the waves have a same width. The serrations of the serrated surface may have a same or different height. The gaps between the serrations may have a same or different width. Preferably, the serrations of the serrated surface have a same height and the gaps between the serrations have a same width.

As shown in FIG. 3, the present invention further provides a method for manufacturing a wire connector with easy entry 3 in accordance with a fifth preferred embodiment. The wire connector with easy entry 3 is suitable for interconnecting multiple wires 31 that each includes a conducting core 311 and an insulating cladding 312 enclosing the conducting core 311. The manufacturing method includes:

(1) providing an insulating tube 32 having a characteristic of shrinking when being heated to a temperature higher than a first temperature and having a melting point at a second temperature;

(2) providing a soldering sleeve 33 having a melting point at a third temperature that is between the first temperature and the second temperature, the soldering sleeve 33 having a corrugated outer surface 331;

(3) disposing the soldering sleeve 33 in the insulating tube 32; and (4) properly applying a heat source to an outer periphery 321 of the insulating tube 32 that corresponds to the soldering sleeve 33 to heat the insulating tube 32 to a temperature above the first temperature but below the third temperature, causing the heated insulating tube 32 to shrink to lodge into corrugation gaps in the outer surface 331 and affix to end surfaces outside a pair of end points 324 of the soldering sleeve 33, such that an inner periphery 322 of the insulating tube 32 forms a smoothly converging configuration 323 oriented toward each end point 324 of the soldering sleeve 33, thereby achieving the wire connector with easy entry 3 such that the insulating tube 32 and the soldering sleeve 33 are tightly connected, and the conducting core 311 is allowed to be readily inserted from two ends of the soldering sleeve 33 so as to prevent the conducting core 311 from being accidently blocked by the end points 324 of the soldering sleeve 33 when the conducting core 311 is inserted into the soldering sleeve 33.

In the embodiment described above, the insulating tube 32 and the soldering sleeve 33 have the same characteristics as those described in the second preferred embodiment.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wire connector with easy entry configured to interconnect multiple wires, wherein each wire comprising a conducting core and an insulating cladding enclosing the conducting core, comprising:

an insulating tube having a characteristic of shrinking when being heated to a temperature higher than a first temperature and having a melting point at a second temperature; and a soldering sleeve disposed in the insulating tube and having a melting point at a third temperature that is between the first temperature and the second temperature, in which the soldering sleeve has an outer surface that is corrugated; characterized in that the soldering sleeve comprises a pair of smoothly radially expanded portions at two ends thereof, and when a heat source is properly applied to an outer periphery of the insulating tube that corresponds to the soldering sleeve to heat the insulating tube to a temperature above the first temperature but below the third temperature, causing the heated insulating tube to shrink to lodge into corrugation gaps of the outer surface and affix to end surfaces outside end points of the radially expanded portions, an inner periphery of the insulating tube forms a smoothly converging configuration oriented toward each end point of the radially expanded portion, thereby achieving the wire connector with easy entry such that the insulating tube and the soldering sleeve are tightly connected and the conducting core is allowed to be readily inserted from the two ends of the soldering sleeve.

2. The wire connector with easy entry in accordance with claim 1, wherein the soldering sleeve has an inner surface that is corrugated.

3. A method for manufacturing a wire connector with easy entry, which is configured to interconnect multiple wires that each wire includes a conducting core and an insulating cladding enclosing the conducting core, characterized in that providing an insulating tube having a characteristic of shrinking when being heated to a temperature higher than a first temperature and having a melting point at a second temperature;

providing a soldering sleeve having a melting point at a third temperature that is between the first temperature and the second temperature, in which the soldering sleeve has a corrugated outer surface and includes a pair of smoothly radially expanded portions at two ends thereof;

disposing the soldering sleeve in the insulating tube; and properly applying a heat source to an outer periphery of the insulating tube that corresponds to the soldering sleeve to heat the insulating tube to a temperature above the first temperature but below the third temperature, causing the heated insulating tube to shrink to lodge into corrugation gaps of the outer surface of the soldering sleeve and affix to end surfaces outside end points of the radially expanded portion, such that an inner periphery of the insulating tube forms a smoothly converging configuration oriented toward each end point of the radially expanded portion, thereby achieving the wire connector with easy entry such that the insulating tube and the soldering sleeve are tightly connected and the conducting core is allowed to be readily inserted from the two ends of the soldering sleeve.

4. The wire connector with easy entry in accordance with claim 3, wherein the soldering sleeve has an inner surface that is corrugated.

5. A wire connector with easy entry configured to interconnect multiple wires, wherein each wire comprises a conducting core and an insulating cladding enclosing the conducting core, comprising:

an insulating tube having a characteristic of shrinking when being heated to a temperature higher than a first temperature and having a melting point at a second temperature; and a soldering sleeve disposed in the insulating tube and having a melting point at a third temperature that is between the first temperature and the second temperature; characterized in that the soldering sleeve has an outer surface that is corrugated, and when a heat source is properly applied to an outer periphery of the insulating tube that corresponds to the soldering sleeve to heat the insulating tube to a temperature above the first temperature but below the third temperature, causing the heated insulating tube to shrink to lodge into corrugation gaps of the outer surface of the soldering sleeve and affix to end surfaces outside a pair of end points of the soldering sleeve, an inner periphery of the insulating tube forms a smoothly converging configuration oriented toward each end point, thereby achieving the wire connector with easy entry such that the insulating tube and the soldering sleeve are tightly connected, and the conducting core is allowed to be readily inserted from two ends of the soldering sleeve.

6. The wire connector with easy entry in accordance with claim 5, wherein the soldering sleeve has an inner surface that is corrugated.

7. A method for manufacturing a wire connector with easy entry, which is configured to interconnect multiple wires that each includes a conducting core and an insulating cladding enclosing the conducting core, comprising:

providing an insulating tube having a characteristic of shrinking when being heated to a temperature higher than a first temperature and having a melting point at a second temperature;

providing a soldering sleeve having a melting point at a third temperature that is between the first temperature and the second temperature, in which the soldering sleeve has an outer surface that is corrugated;

disposing the soldering sleeve in the insulating tube; and properly applying a heat source to an outer periphery of the insulating tube that corresponds to the soldering sleeve to heat the insulating tube to a temperature above the first temperature but below the third temperature, causing the heated insulating tube to shrink to lodge into corrugation gaps of the outer surface of the soldering sleeve and affix to end surfaces outside a pair of end points of the soldering sleeve, such that an inner periphery of the insulating tube forms a smoothly converging configuration oriented toward each end point, thereby achieving the wire connector with easy entry such that the insulating tube and the soldering sleeve are tightly connected, and the conducting core is allowed to be readily inserted from two ends of the soldering sleeve.

8. The method for manufacturing the wire connector with easy entry in accordance with claim 7, wherein the soldering sleeve has an inner surface that is corrugated.

* * * * *